US005199467A

United States Patent [19]

Lee

[11] Patent Number: 5,199,467

[45] Date of Patent: Apr. 6, 1993

[54] PAPERMAKERS FABRIC WITH STACKED MACHINE DIRECTION YARNS

[75] Inventor: Henry J. Lee, Summerville, S.C.

[73] Assignee: Asten Group, Inc., Charleston, S.C.

[21] Appl. No.: 855,904

[22] Filed: Apr. 13, 1992

Related U.S. Application Data

[63] Continuation of Ser. No. 534,164, Jun. 6, 1990, Pat. No. 5,103,874.

[51] Int. Cl.[5] ..... D03D 13/00; D03D 15/00

[52] U.S. Cl. ..... 139/383 A; 162/900; 428/225

[58] Field of Search ..... 139/413, 383 A, 425 A, 139/383 AA, 420 A; 162/DIG. 1, 358; 428/234, 222, 229

[56] References Cited

U.S. PATENT DOCUMENTS

| | | | |
|---|---|---|---|
| 1,050,406 | 1/1913 | Veit | 139/413 |
| 1,268,788 | 6/1918 | Brooks . | |
| 2,854,032 | 8/1953 | Santos | 139/411 |
| 3,622,415 | 11/1971 | Kunsman . | |
| 3,815,645 | 6/1974 | Codorniu . | |
| 4,026,331 | 5/1977 | Lees et al. | 139/383 A |
| 4,123,022 | 10/1978 | Dutt et al. | 139/383 AA |
| 4,142,557 | 3/1979 | Kositzke | 139/425 A |
| 4,290,209 | 9/1981 | Buchanan et al. | 139/420 A |
| 4,351,874 | 9/1982 | Kirby | 428/229 |
| 4,356,225 | 10/1982 | Dufour | 428/234 |
| 4,379,735 | 4/1983 | MacBean | 139/425 A |
| 4,438,788 | 3/1984 | Harwood | 139/383 A |
| 4,438,789 | 3/1984 | MacBean | 139/383 A |
| 4,461,803 | 7/1984 | Booth et al. | 428/234 |
| 4,469,142 | 9/1984 | Harwood | 139/383 A |
| 4,537,816 | 8/1985 | Booth et al. | 428/234 |
| 4,601,785 | 7/1986 | Lilja et al. . | |
| 4,621,663 | 11/1986 | Malmendier | 139/383 A |
| 4,705,601 | 11/1987 | Chiu | 139/383 A |
| 4,737,241 | 4/1988 | Gulya . | |
| 4,755,420 | 7/1988 | Baker et al. | 428/222 |
| 4,815,499 | 3/1989 | Johnson | 139/383 A |
| 4,824,525 | 4/1989 | Penven | 162/358 |
| 4,846,231 | 7/1989 | Penven | 139/383 A |
| 4,865,083 | 9/1989 | Cunnane | 139/383 A |
| 4,883,096 | 11/1989 | Penven | 139/383 A |
| 4,887,648 | 12/1989 | Cunnane . | |
| 4,902,383 | 2/1990 | Penven . | |
| 4,921,750 | 5/1990 | Todd | 139/383 A |
| 4,938,269 | 7/1990 | Nicholas et al. . | |
| 4,991,630 | 2/1991 | Penven . | |
| 5,066,532 | 11/1991 | Gaisser . | |
| 5,103,874 | 4/1992 | Lee | 139/383 |

FOREIGN PATENT DOCUMENTS

| | | | |
|---|---|---|---|
| 0144592 | 6/1985 | European Pat. Off. | 139/383 A |
| 211426 | 2/1987 | European Pat. Off. | 139/383 A |
| 2407291 | 5/1979 | France | 139/383 A |

*Primary Examiner*—Andrew M. Falik
*Attorney, Agent, or Firm*—Volpe & Koenig

[57] ABSTRACT

An industrial fabric, preferably for use as a papermakers fabric, having a system of flat monofilament machine direction yarns hereinafter MD yarns, which are woven in stacked, vertical alignment throughout the body of the fabric. Preferably, each upper MD yarn defines floats on the upper surface of the fabric and is vertically stacked with respect to the lower MD yarns. In the preferred embodiment, the same type and size yarns are used throughout the machine direction yarn system.

2 Claims, 3 Drawing Sheets

PAPERMAKERS FABRIC WITH STACKED MACHINE DIRECTION YARNS

This is a continuation of application Ser. No. 07/534,164, filed Jun. 6, 1990.

The present invention relates to papermakers fabrics and in particular to fabrics comprised of flat monofilament yarns.

BACKGROUND OF THE INVENTION

Papermaking machines generally are comprised of three sections: forming, pressing, and drying. Papermakers fabrics are employed to transport a continuous paper sheet through the papermaking equipment as the paper is being manufactured. The requirements and desirable characteristics of papermakers fabrics vary in accordance with the particular section of the machine where the respective fabrics are utilized.

With the development of synthetic yarns, shaped monofilament yarns have been employed in the construction of papermakers fabrics. For example, U.S. Pat. No. 4,290,209 discloses a fabric woven of flat monofilament warp yarns; U.S. Pat. No. 4,755,420 discloses a non-woven construction where the papermakers fabric is comprised of spirals made from flat monofilament yarns.

Numerous weaves are known in the art which are employed to achieve different results. For example, U.S. Pat. No. 4,438,788 discloses a dryer fabric having three layers of cross machine direction yarns interwoven with a system of flat monofilament machine direction yarns such that floats are created on both the top and bottom surfaces of the fabric. The floats tend to provide a smooth surface for the fabric.

Permeability is an important criteria in the design of papermakers fabrics. In particular, with respect to fabrics made for running at high speeds on modern drying equipment, it is desirable to provide dryer fabrics with relatively low permeability.

U.S. Pat. No. 4,290,209 discloses the use of flat monofilament warp yarns woven contiguous with each other to provide a fabric with reduced permeability. However, even where flat warp yarns are woven contiguous with each other, additional means, such as stuffer yarns, are required to reduce the permeability of the fabric. As pointed out in that patent, it is desirable to avoid the use of fluffy, bulky stuffer yarns to reduce permeability which make the fabric susceptible to picking up foreign substances or retaining water.

U.S. Pat. No. 4,290,209 and U.S. Pat. No. 4,755,420 note practical limitations in the aspect ratio (cross-sectional width to height ratio) of machine direction warp yarns defining the structural weave of a fabric. The highest practical aspect ratio disclosed in those patents is 3:1, and the aspect ratio is preferably, less than 2:1.

U.S. Pat. No. 4,621,663, assigned to the assignee of the present invention, discloses one attempt to utilize high aspect ratio yarns (on the order of 5:1 and above) to define the surface of a papermakers dryer fabric. As disclosed in that patent, a woven base fabric is provided to support the high aspect ratio surface yarns. The woven base fabric is comprised of conventional round yarns and provides structural support and stability to the fabric disclosed in that patent.

U.S. Pat. No. 4,815,499 discloses the use of flat yarns in the context of a forming fabric. That patent discloses a composite fabric comprised of an upper fabric and a lower fabric tied together by binder yarns. The aspect ratio employed for the flat machine direction yarns in both the upper and lower fabrics are well under 3:1.

SUMMARY AND OBJECTS INVENTION

The present invention provides a papermakers fabric having a system of flat monofilament machine direction yarns (hereinafter MD yarns) which are stacked to control the permeability of the fabric. The present weave also provides for usage of high aspect ratio yarns as structural weave components. The system of MD yarns comprises upper and lower yarns which are vertically stacked. It is preferred that at least the upper MD yarns are woven with an actual warp fill of at least 80%. Preferably, the upper MD yarns define floats on the upper surface of the fabric and each upper MD yarn is paired in a vertically stacked orientation with a lower MD yarn. The lower MD yarns may weave in an inverted image of the upper MD yarns to provide floats on the bottom fabric surface or may weave with a different repeat to provide a different surface on the bottom of the fabric.

At least the upper MD yarns are flat monofilament yarns woven contiguous with each other to reduce the permeability of the fabric and to lock in the machine direction alignment of the stacking pairs of MD yarns. In the preferred embodiment, the same type and size yarns are used throughout the machine direction yarn system and both the top and the bottom MD yarns weave contiguously with adjacent top and bottom MD yarns, respectively. The stacked, contiguous woven machine direction system provides stability and permits the MD yarns to have a relatively high aspect ratio, cross-sectional width to height, of greater than 3:1.

It is an object of the invention to provide a papermakers fabrics having permeability controlled with woven flat machine direction yarns.

It is a further object of the invention to provide a low permeability fabric constructed of all monofilament yarns without the use of bulky stuffer yarns and without sacrificing strength or stability.

Other objects and advantages will become apparent from the following description of presently preferred embodiments.

DETAILED DESCRIPTION OF PRESENTLY PREFERRED EMBODIMENTS

Figure 1:
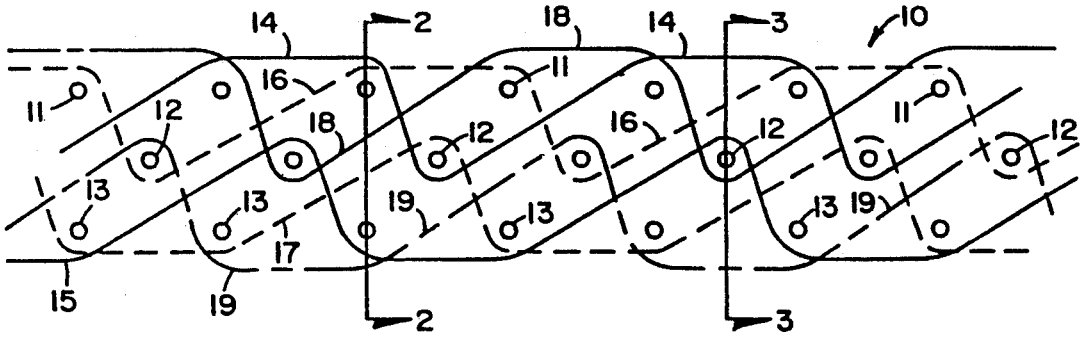
FIG. 1 is a schematic diagram of a papermakers fabric made in accordance with the teachings of the present invention.
Figure 2:
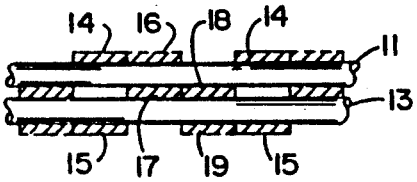
FIG. 2 is a cross-sectional view of the fabric depicted in FIG. 1 along line 2—2.
Figure 3:
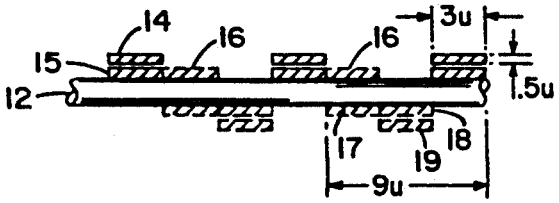
FIG. 3 is a cross-sectional view of the fabric depicted in FIG. 1 along line 3—3.

Referring to FIGS. 1, 2, and 3, there is shown a papermakers dryer fabric 10 comprising upper, middle and lower layers of cross machine direction (hereinafter CMD) yarns 11, 12, 13, respectively, interwoven with a system of MD yarns 14–19 which sequentially weave in a selected repeat pattern. The MD yarn system comprises upper MD yarns 14, 16, 18 which interweave with CMD yarns 11, 12 and lower MD yarns 15, 17, 19 which interweave with CMD yarns 12, 13.

The upper MD yarns 14, 16, 18 define floats on the top surface of the fabric 10 by weaving over two upper layer CMD yarns 11 dropping into the fabric to weave in an interior knuckle under one middle layer CMD yarn 12 and under one CMD yarn 11 and thereafter rising to the surface of the fabric to continue the repeat of the yarn. The floats over upper layer CMD yarns 11 of upper MD yarns 14, 16, 18 are staggered so that all of the upper and middle layer CMD yarns 11, 12 are maintained in the weave.

As will be recognized by those skilled in the art, the disclosed weave pattern with respect to FIGS. 1, 2, and 3, results in the top surface of the fabric having a twill pattern. Although the two-float twill pattern represented in FIGS. 1, 2, and 3 is a preferred embodiment, it will be recognized by those of ordinary skill in the art that the length of the float, the number of MD yarns in the repeat, and the ordering of the MD yarns may be selected as desired so that other patterns, twill or non-twill, are produced.

As best seen in FIGS. 2 and 3, lower MD yarns 15, 17, 19, weave directly beneath upper MD yarns 14, 16, 18, respectively, in a vertically stacked relationship. The lower yarns weave in an inverted image of their respective upper yarns. Each lower MD yarn 15, 17, 19 floats under two lower layer CMD yarns 13, rises into the fabric over one CMD yarn 13 and forms a knuckle around one middle layer CMD yarn 12 whereafter the yarn returns to the lower fabric surface to continue its repeat floating under the next two lower layer CMD yarns 13.

With respect to each pair of stacked yarns, the interior knuckle, formed around the middle layer CMD yarns 12 by one MD yarn, is hidden by the float of the other MD yarn. For example, in FIGS. 1 and 3, lower MD yarn 15 is depicted weaving a knuckle over CMD yarn 12 while MD yarn 14 is weaving its float over CMD yarns 11, thereby hiding the interior knuckle of lower MD yarn 15. Likewise, with respect to FIGS. 1 and 3, upper MD yarn 18 is depicted weaving a knuckle under yarn CMD yarn 12 while it is hidden by lower MD yarn 19 as it floats under CMD yarns 13.

The upper MD yarns 14, 16, 18, are woven contiguous with respect to each other. This maintains their respective parallel machine direction alignment and reduces permeability. Such close weaving of machine direction yarns is known in the art as 100% warp fill as explained in U.S. Pat. No. 4,290,209. As taught therein (and used herein), actual warp fill in a woven fabric may vary between about 80%–125% in a single layer and still be considered 100% warp fill.

The crowding of MD yarns 14, 16, and 18 also serves to force MD yarns 15, 17, 19, into their stacked position beneath respective MD yarns 14, 16, 18. Preferably MD yarns 15, 17, and 19 are the same size as MD yarns 14, 16, and 18 so that they are likewise woven 100% warp fill. This results in the overall fabric of the preferred embodiment having 200% warp fill of MD yarns.

Since the lower MD yarns 15, 17, 19 are also preferably woven 100% warp fill, they likewise have the effect of maintaining the upper MD yarns 14, 16, 18 in stacked relationship with the respect to lower MD yarns 15, 17, 19. Accordingly, the respective MD yarn pairs 14 and 15, 16 and 17, 18 and 19 are doubly locked into position thereby enhancing the stability of the fabric.

As set forth in the U.S. Pat. No. 4,290,209, it has been recognized that machine direction flat yarns will weave in closer contact around cross machine direction yarns than round yarns. However, a 3:1 aspect ratio was viewed as a practical limit for such woven yarns in order to preserve overall fabric stability. The present stacked MD yarn system preserves the stability and machine direction strength of the fabric and enables the usage of yarns with increased aspect ratio to more effectively control permeability.

The high aspect ratio of the MD yarns translates into reduced permeability. High aspect ratio yarns are wider and thinner than conventional flat yarns which have aspect ratios less than 3:1 and the same cross-sectional area. Equal cross-sectional area means that comparable yarns have substantially the same linear strength. The greater width of the high aspect ratio yarns translates into fewer interstices over the width of the fabric than with conventional yarns so that fewer openings exist in the fabric through which fluids may flow. The relative thinness of the high aspect ratio yarns enables the flat MD yarns to more efficiently cradle, i.e. brace, the cross machine direction yarns to reduce the size of the interstices between machine direction and cross machine direction yarns.

Figure 4:
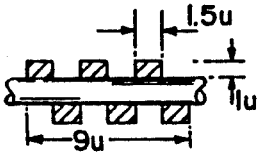
FIG. 4 PRIOR ART
FIG. 4 is a cross-sectional view of a prior art weave construction.

For example, as illustrated in FIG. 4, a fabric woven with a single layer system of a flat machine direction warp having a cross-sectional width of 1.5 units and a cross-sectional height of 1 unit, i.e. an aspect ratio of 1.5:1, is shown. Such fabric could be replaced by a fabric having the present dual stacked MD yarn system with MD yarns which are twice the width, i.e. 3 units, and half the height, i.e. 0.5 units. Such MD yarns thusly having a fourfold greater aspect ratio of 6:1, as illustrated in FIG. 3.

The thinner, wider MD yarns more efficiently control permeability while the machine direction strength of the fabric remains essentially unaltered since the cross-sectional area of the MD yarns over the width of the fabric remains the same. For the above example, illustrated by FIGS. 4 and 3, the conventional single MD yarn system fabric has six conventional contiguous flat yarns over 9 units of the fabric width having a cross-sectional area of 9 square units, i.e. 6*(1u.*1.5u.). The thinner, wider high aspect ratio yarns, woven as contiguous stacked MD yarns, define a fabric which has three stacked pairs of MD yarns over 9 units of fabric width. Thus such fabric also has a cross-sectional area of 9 square units, i.e. (3*(0.5u.*3u.))+(3*(0.5u.*3u.)), over 9 units of fabric width.

In one example, a fabric was woven in accordance with FIGS. 1, 2 and 3, wherein the CMD yarns 11, 12, 13 were polyester monofilament yarns 0.6 mm in diameter interwoven with MD yarns 14–19 which were flat polyester monofilament yarns having a width of 1.12 mm and a height of 0.2 mm. Accordingly, the aspect ratio of the flat MD yarns was 5.6:1. The fabric was woven at 48 warp ends per inch with a loom tension of 40 PLI (pounds per linear inch) and 12.5 CMD pick yarns per inch per layer (three layers).

The fabric was heat set in a conventional heat setting apparatus under conditions of temperature, tension and time within known ranges for polyester, monofilament yarns. For example, conventional polyester fabrics are heat set within parameters of 340° F.–380° F. temperature, 6–15 PLI (pounds per linear inch) tension, and 3–4 minutes time. However, due to their stable structure, the fabrics of the present invention are more tolerant to variations in heat setting parameters.

The fabric exhibited a warp modulus of 6,000 PSI (pounds per square inch) measured by the ASTM D-1682-64 standard of the American Society for Testing and Materials. The fabric stretched less that 0.2% in length during heat setting. This result renders the manufacture of fabrics in accordance with the teachings of the present invention very reliable in achieving desired dimensional characteristic as compared to conventional fabrics.

The resultant heat set fabric had 12.5 CMD yarns per inch per layer with 106% MD warp fill with respect to both upper and lower MD yarns resulting in 212% actual warp fill for the fabric. The finished fabric has a permeability of 83CFM as measured by the ASTM D-737-75 standard.

Figure 5:
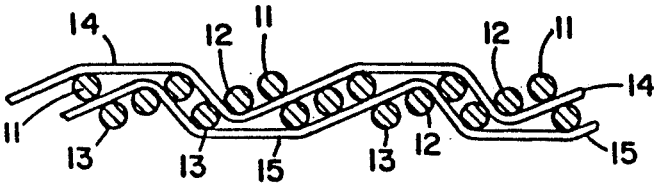
FIG. 5 illustrates the actual yarn structure of the fabric depicted in FIG. 1 in the finished fabric showing only two representative stacked MD yarns.

As illustrated in FIG. 5, when the fabric 10 is woven the three layers of CMD yarns 11, 12, 13 become compressed. This compression along with the relatively thin dimension of the MD yarns reduces the caliper of the fabric. Accordingly, the overall caliper of the fabric can be maintained relatively low and not significantly greater than conventional fabrics woven without stacked MD yarn pairs. In the above example, the caliper of the finished fabric was 0.050 inches.

It will be recognized by those of ordinary skill in the art that if either top MD yarns 14, 16, 18 or bottom MD yarns 15, 17, 19 are woven at 100% warp fill, the overall warp fill for the stacked fabric will be significantly greater than 100% which will contribute to the reduction of permeability of the fabric. The instant fabric having stacked MD yarns will be recognized as having a significantly greater percentage of a warp fill than fabrics which have an actual warp fill of 125% of non-stacked MD yarns brought about by crowding and lateral undulation of the warp strands. Although the 200% warp fill is preferred, a fabric may be woven having 100% fill for either the upper or lower MD yarns with a lesser degree of fill for the other MD yarns by utilizing yarns which are not as wide as those MD yarns woven at 100% warp fill. For example, upper yarns 14, 16, 18 could be 1 unit wide with lower layer yarns 15, 17, 19 being 0.75 units wide which would result in a fabric having approximately 175% warp fill.

Such variations can be used to achieve a selected degree of permeability. Alternatively, such variations could be employed to make a forming fabric. In such a case, the lower MD yarns would be woven 100% warp fill to define the machine side of the fabric and the upper MD yarns would be woven at a substantially lower percentage of fill to provide a more open paper forming surface.

Figure 6:
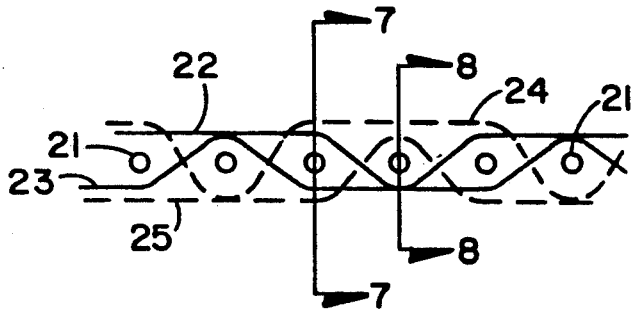
FIG. 6 is a schematic view of a second embodiment of a fabric made in accordance with the present invention.
Figure 7:
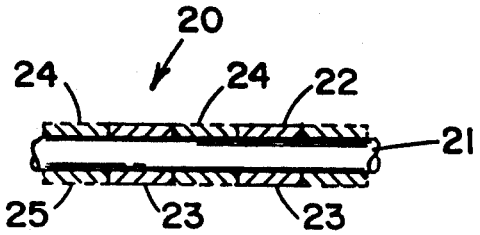
FIG. 7 is a cross-sectional view of the fabric depicted in FIG. 6 along line 7—7.
Figure 8:
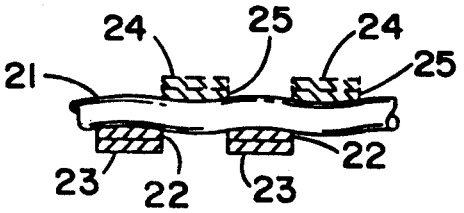
FIG. 8 is a cross-sectional view of the fabric depicted in FIG. 6 along line 8—8.

Referring to FIGS. 6, 7 and 8, there is shown a second preferred embodiment of a fabric 20 made in accordance with the teachings of the present invention. Papermakers fabric 20 is comprised of a single layer of CMD yarns 21 interwoven with a system of stacked MD yarns 22–25 which weave in a selected repeat pattern. The MD yarn system comprises upper MD yarns 22, 24 which define floats on the top surface of the fabric 20 by weaving over three CMD yarns 21, dropping into the fabric to form a knuckle around the next one CMD yarn 21, and thereafter continuing to float over the next three CMD yarns 21 in the repeat.

Lower MD yarns 23, 25, weave directly beneath respective upper MD yarns 22, 24 in a vertically stacked relationship. The lower MD yarns weave in an inverted image of their respective upper MD yarns. Each lower MD yarn 23, 25 floats under three CMD yarns 21, weaves upwardly around the next one CMD yarn forming a knuckle and thereafter continues in the repeat to float under the next three CMD yarns 21.

As can be seen with respect to FIGS. 6 and 8, the knuckles formed by the lower MD yarns 23, 25 are hidden by the floats defined by the upper MD yarns 22, 24 respectively. Likewise the knuckles formed by the upper MD yarns 22, 24 are hidden by the floats of the lower MD yarns 23, 25 respectively.

The caliper of the fabric proximate the knuckle area shown in FIG. 8, has a tendency to be somewhat greater than the caliper of the fabric at non-knuckle CMD yarns 21, shown in FIG. 7. However, the CMD yarns 21 around which the knuckles are formed become crimped which reduces the caliper of the fabric in that area as illustrated in FIG. 8. Additionally, slightly larger size CMD yarns may be used for CMD yarns 21, shown in FIG. 7, which are not woven around as knuckles by the MD yarns.

A fabric was woven in accordance with FIGS. 6, 7 and 8, wherein the CMD yarns 21 were polyester monofilament yarns 0.7 mm in diameter interwoven with MD yarns 22–25 which were flat polyester monofilament yarns having a width of 1.12 mm and a height of 0.2 mm. Accordingly, the aspect ratio of the flat MD yarns was 5.6:1. The fabric was woven at 22 CMD pick yarns per inch. The fabric was heat set using conventional methods. The fabric exhibited a modulus of 6,000 PSI. The fabric stretched less than 0.2% in length during heat setting. The resultant fabric had 22 CMD yarns per inch with 106% MD warp fill with respect to both upper and lower MD yarns resulting in 212% actual warp fill for the fabric. The finished fabric had a caliper of 0.048 inches and an air permeability of 60 CFM.

The preferred inverted image weave of the lower MD yarns facilitates the creation of seaming loops at the end of the fabric which enable the fabric ends to be joined together. In forming a seaming loop, the upper MD yarns extend beyond the end of the fabric and the respective lower yarns are trimmed back a selected distance from the fabric end. The upper MD yarns are then bent back upon themselves and rewoven into the space vacated by the trimmed lower MD yarns. When the upper MD yarns are backwoven into the space previously occupied by the lower MD yarns, their crimp matches the pattern of the lower MD yarns, thereby locking the resultant end loops in position. Similarly, alternate top MD yarns can be backwoven tightly against the end of the fabric such that loops formed on the opposite end of the fabric can be intermeshed in the spaces provided by the non-loop forming MD yarns to seam the fabric via insertion of a pintle through the intermeshed end loops.

Since the top and bottom machine direction yarns are stacked, the resultant end loops are orthogonal to the plane of the fabric surface and do not have any twist. In conventional backweaving techniques, the loop defining yarns are normally backwoven into the fabric in a space adjacent to the yarn itself. Such conventional loop formation inherently imparts a twist to the seaming loop, see U.S. Pat. No. 4,438,788, FIG. 6.

Figure 9:
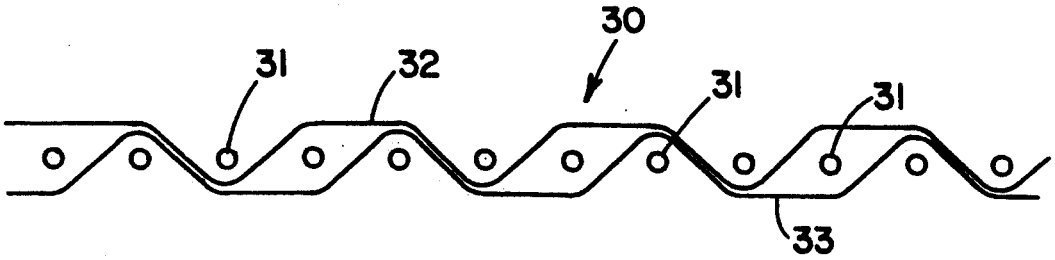
FIG. 9 is a schematic view of a third alternate embodiment of a fabric made in accordance with the teachings of the present invention showing only one pair of stacked MD yarns.

With reference to FIG. 9, a third embodiment of a papermakers fabric 30 is shown. Fabric 30 comprises a single layer of CMD yarns 31 interwoven with stacked pairs of flat monofilament yarns in a selected repeat pattern. For clarity, only one pair of stacked MD yarns is shown comprising upper MD yarn 32 and lower MD yarn 33. The upper MD yarns weave in a float over two CMD yarns 31, form a single knuckle under the next CMD yarn 31 and thereafter repeat. Similarly the lower MD yarns weave in an inverted image of the upper MD yarns weaving under two CMD yarns 31, forming a knuckle over the next CMD yarn 31 and then returning to the bottom surface of the fabric in the repeat. Since the repeat of both the upper and lower MD yarns is with respect to three CMD yarns 31, a total of three different stacked pairs of yarns comprise the weave pattern of the MD yarn system.

A fabric was woven in accordance with FIG. 9 wherein the CMD yarns 31 were polyester monofilament yarns 0.7 mm in diameter interwoven with MD yarns which were flat polyester monofilament yarns having a width of 1.12 mm and a height of 0.2 mm. Accordingly, the aspect ratio of the flat MD yarns was 5.6:1. fabric was woven 48 warp ends per inch under a loom tension of 60 PLI and 18 CMD pick yarns per inch. The fabric was heat set using conventional methods. The fabric exhibited a modulus of 6,000 PSI. The fabric stretched less than 0.2% in length during heat setting. The resultant fabric had 18 CMD yarns per inch with 106% MD warp fill with respect to both upper and lower MD yarns resulting in 212% actual warp fill for the fabric. The finished fabric having a caliper of 0.046 inches and an air permeability of 66 CFM.

Figure 10:
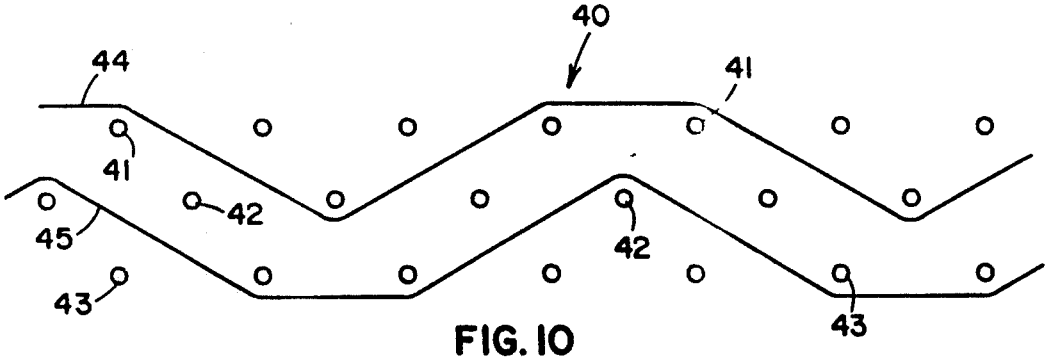
FIG. 10 is a schematic view of a fourth alternate embodiment of a fabric made in accordance with the teachings of the present invention showing only one pair of stacked MD yarns.

With reference to FIG. 10, a fourth embodiment of a papermakers fabric 40 is shown. Fabric 40 comprises upper, middle and lower layers of CMD yarns 41, 42, 43, respectively, interwoven with stacked pairs of flat monofilament yarns in a selected repeat pattern. For clarity, only one pair of stacked MD yarns is shown comprising upper MD yarn 44 and lower MD yarn 45. The upper MD yarns weave in a float over two upper layer CMD yarns 41, under the next yarn 41 and a middle layer yarn 42 to form a single knuckle, under the next CMD yarn 41 and thereafter rise to the top surface to continue to repeat. Similarly, the lower MD yarns weave in an inverted image of the upper MD yarns weaving under two lower layer CMD yarns 43 over the next CMD yarn 43 and a middle CMD yarn 42 forming a knuckle, over the next CMD yarn 43 then returning to the bottom surface of the fabric to repeat. Since the repeat of both the upper and lower MD yarns is with respect to four upper and lower CMD yarns 41, 43, respectively, a total of four different stacked pairs of yarns comprise the weave pattern of the MD yarn system.

A fabric was woven in accordance with FIG. 10, wherein the upper and lower layer CMD yarns 41, 43 were nylon-sheathed, multifilament polyester yarns 0.62 mm in diameter and the middle layer CMD yarns 42 were polyester monofilament yarns 0.5 mm in diameter interwoven with MD yarns 22–25 which were flat polyester monofilament yarns having a width of 0.60 mm and a height of 0.38 mm. Accordingly, the aspect ratio of the flat MD yarns was 1.58:1. The fabric was woven with 96 warp ends per inch under a loom tension of 40 PLI and 15 CMD pick yarns per inch per layer. The fabric was heat set using conventional methods. The resultant fabric had 15 CMD yarns per inch per layer with 113% MD warp fill with respect to both upper and lower MD yarns resulting in 226% actual warp fill for the fabric. The finished fabric had a caliper of 0.075 inches and an air permeability of 60 CFM.

Figure 11:
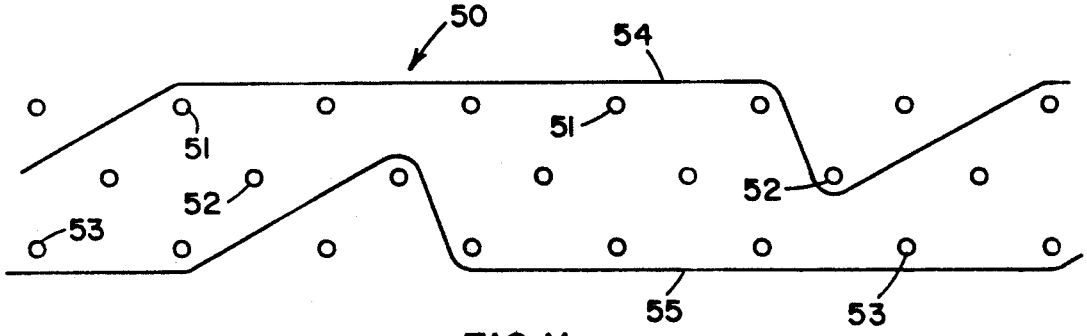
FIG. 11 is a schematic view of a fifth alternate embodiment of a fabric made in accordance with the teachings of the present invention showing only one pair of stacked MD yarns.
Figure 12:
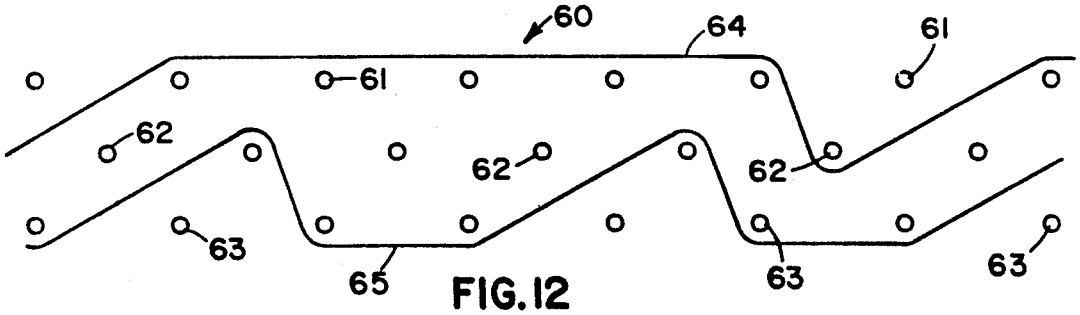
FIG. 12 is a schematic view of a sixth alternate embodiment of a fabric made in accordance with the teachings of the present invention showing only one pair of stacked MD yarns.
Figure 13:
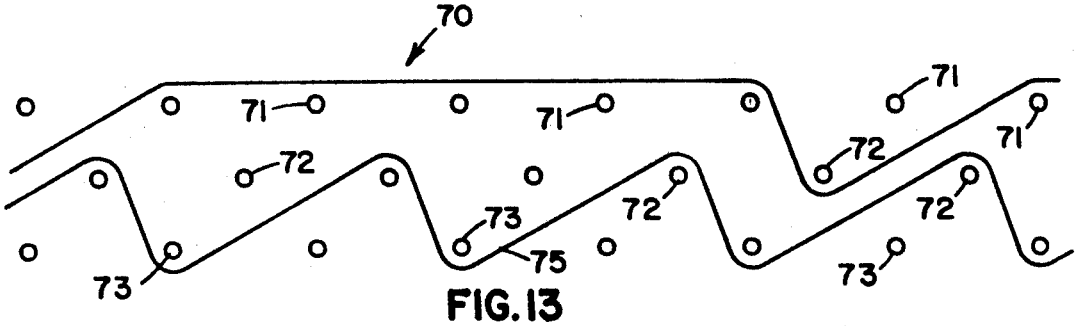
FIG. 13 is a schematic view of a seventh alternate embodiment of a fabric made in accordance with the teachings of the present invention showing only one pair of stacked MD yarns.

FIGS. 11, 12 and 13 illustrate the fifth, sixth and seventh embodiments of the present invention. FIG. 11 illustrates the weave of a relatively long float on both sides of the fabric; FIG. 12 illustrates how a stacked pair MD yarn weave can define floats of different lengths on opposite sides of the fabric; and FIG. 13 illustrates how a stacked pair MD yarn weave can be used to construct fabrics having MD knuckles on one side of the fabric.

Relatively long floats predominating the surfaces of a dryer fabric are beneficial for both the paper-carrying (or forming or sheet support) side as well as the machine (or roller contact) side of the fabric. On the paper-carrying side, long floats provide greater contact area with the paper sheet for increased heat transfer. On the machine side, long floats provide increased wear surface and con-act area to reduce bounce and flutter. The stacked pair MD yarn weave is versatile in allowing different surfaces to be defined on the top and bottom sides of the fabric. Accordingly, fabrics made in accordance with the teachings of the present invention may be used for other industrial purposes such as in the drying of sludge.

With respect to FIG. 11, a fabric 50 is illustrated comprising three layers of yarns 51, 52, and 53 respectively. In this construction, the MD yarn pairs, such as the pair formed by upper layer yarn 54 and lower layer yarn 55, define relatively long floats on both the top and bottom surfaces of the fabric. Upper yarn 54 weaves over five upper layer CMD yarns 51, drops into the fabric to form a knuckle under one middle layer CMD yarn 52, weaves under the next upper layer yarn 51 and thereafter repeats. Lower MD yarn 55 weaves in an inverted image under five lower layer CMD yarns 53, rising into the fabric over the next CMD 53 to weave a knuckle over one middle layer CMD yarn 52 thereafter dropping to the bottom surface of the fabric to continue its repeat. In such a construction, six pairs of stacked MD yarns are utilized in the repeat of the fabric and are sequentially woven in a selected sequence to produce a desired pattern on the surfaces of the fabric which will be predominated by the MD yarn floats.

The embodiment shown in FIG. 12 depicts a fabric 60 in which the MD yarns weave with a five-float repeat on the top fabric surface and a two-float repeat on the bottom fabric surface. For example, upper MD yarn 64 interweaves with upper and middle CMD yarns 61, 62 in the same manner that upper MD yarn 54 weaves with respective CMD yarns 51, 52 with respect to fabric 50 in FIG. 11. However, lower MD yarn 65, which forms a stacked pair with upper MD yarn 64, weaves in a two-float bottom repeat with respect lower and middle CMD yarns 63, 62. For example, lower MD yarn 65 floats under two lower layer CMD yarns 63, rises above the next CMD yarn 63 to form a knuckle over one middle layer CMD yarn 62 and thereafter drops to the bottom surface of the fabric 60 to continue to repeat. As with the other embodiments discussed above, the interior knuckles formed by the lower MD yarns are hidden by the upper MD yarn of the respective stacked pair and vice-versa.

The construction shown in FIG. 12 permits different surfaces to be defined on the top and bottom of the fabric while utilizing the benefits of the stacked MD yarn pairing.

The embodiment shown in FIG. 13 discloses another example of a fabric 70 having five-float MD yarns predominating the upper surface of the fabric, but with MD knuckles on the lower surface of the fabric. This type of construction may be advantageously used to construct a forming fabric where the upper fabric surface, having relatively long floats, would be used as the machine side of the fabric and the knuckled lower surface of the fabric would be used as the paper forming side.

Fabric 70 includes three layers of CMD yarns 71, 72, 73 respectively which interweave with stacked pairs of MD yarns to define this construction. Only one pair of stacked pair of MD yarns 74, 75 is depicted for clarity. Upper MD yarn 74 weaves in a five-float pattern with respect to upper and middle layer CMD yarns 71, 72 in the same manner as upper MD yarn 54 with respect to fabric 50 shown in FIG. 11. Lower MD yarn 75 weaves three interior knuckles and three lower surface knuckles with respect to middle and lower layer CMD yarns 72, 73 under each upper surface float of its respective MD yarn pair yarn 74. The repeat of the upper MD yarns is defined with respect to six upper layer CMD yarns 71 and the repeat of the lower MD yarns is defined with respect to only two lower layer CMD yarns 73. Accordingly, there are six different pairs of stacked MD yarns which constitute the MD yarn system which, as noted above, can be arranged such that a desired pattern is formed on the upper surface of the fabric.

Generally for stacked pair weaves, the repeat of the upper MD yarns will be equally divisible by, or an equal multiple of, the repeat of the lower MD yarns in defining the stacking pair relationship. For example, with respect to FIG. 12 the repeat of the upper MD yarns is six upper layer CMD yarns which is equally divisible by the repeat of the lower MD yarns which is three lower layer CMD yarns.

Figure 14:
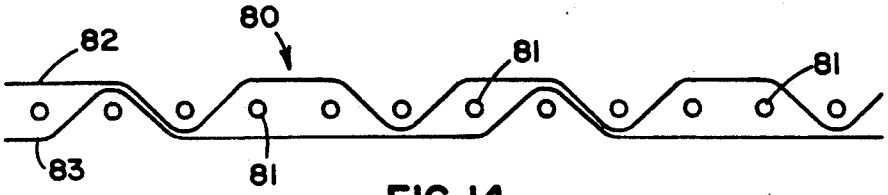
FIG. 14 is a schematic view of a eighth alternate embodiment of a fabric made in accordance with the teachings of the present invention showing only one pair of stacked MD yarns.

With respect to the eighth alternate embodiment shown in FIG. 14, a fabric 80 is illustrated having a single layer of CMD yarns 81 and a representative stacked pair of MD yarns 82, 83. Upper MD yarn 82 weaves with two floats over CMD yarns 81 with a repeat occurring with respect to three CMD yarns 81. Lower MD yarn 83 weaves with five floats under CMD yarns 81 with a repeat of six CMD yarns 81. Thus, in fabric 80, the repeat of the upper MD yarns, which is three, is an equal multiple of the repeat of lower MD yarns, which is six.

A variety of other weave patterns employing the paired stacked weave construction of the instant invention may be constructed within the scope of the present invention. For example, in some applications it may be desirable to have MD yarn surface floats over six or more CMD yarns. Such fabrics are readily constructed in accordance with the teachings of the present invention.

What I claim is:

1. A woven papermaking fabric for formation of a paper sheet in a papermaking machine about which the papermaking fabric travels, said papermaking fabric having machine direction yarns which correspond to the longitudinal direction of the papermaking fabric as it travels on the papermaking machine, the woven fabric has a paper forming side and a roller contact side and is comprised of:

a first system of longitudinal, monofilament machine direction yarns that predominate on the paper forming side of said fabric;

a second system of longitudinal, monofilament machine direction yarns that predominate on the roller contact side of said fabric;

the yarns of the first and second systems are arranged in vertically stacked pairs of first and second machine direction yarns positioned one above the other in a superimposed relationship; and a system of cross machine direction yarns interwoven with the yarns of the machine direction systems in a repeat pattern that maintains the stacked relationship of the paired yarns such that the yarns of the first system do not pass to the roller contact side and the yarns of the second system do not pass to the paper forming side.

2. A woven papermaking fabric for a papermaking machine having machine rollers about which the papermaking fabric travels, the papermaking fabric has a paper support side and a roller contact side and has machine direction yarns which correspond to the longitudinal direction of the papermaking fabric as it travels on the papermaking machine, the woven fabric comprising:

a first system of longitudinal, monofilament machine direction yarns with a warp fill of at least 80% that dominate the paper sheet side of the fabric;

a second system of longitudinal, monofilament machine direction yarns that dominate the roller contact side of the fabric;

a system of cross machine direction (CMD) yarns; and the yarns of the first and second machine direction systems are arranged in vertically stacked pairs of first and second machine direction yarns positioned one above the other in a superimposed relationship and are interwoven with the cross machine direction yarns in a repeat pattern that maintains the stacked relationship of the paired yarns such that the yarns of the first system do not pass to the roller contact side and the yarns of the second system do not pass to the paper sheet support side.

* * * * *

UNITED STATES PATENT AND TRADEMARK OFFICE

CERTIFICATE OF CORRECTION

PATENT NO. : 5,199,467

DATED : April 6, 1993

INVENTOR(S) : Henry J. Lee

It is certified that error appears in the above-indentified patent and that said Letters Patent is hereby corrected as shown below:

At column 7, line 49, before the word "fabric", insert -- The --.

At column 8, line 45, delete "con-act", and insert therefor -- contact --.

At column 10, line 44, after the word "paper", insert -- sheet --.

At column 10, line 50, delete "with a warp fill of at least 80%".

Signed and Sealed this

Fifteenth Day of August, 1995

*Attest:*

Bruce Lehman

BRUCE LEHMAN

*Attesting Officer*

*Commissioner of Patents and Trademarks*